US010186189B2

(12) United States Patent
Shin

(10) Patent No.: US 10,186,189 B2
(45) Date of Patent: Jan. 22, 2019

(54) ORGANIC LIGHT EMITTING DISPLAY DEVICE FOR COMPENSATING DEGRADATION OF A PIXEL AND METHOD OF DRIVING THE SAME

(71) Applicant: SAMSUNG DISPLAY CO., LTD., Yongin-si, Gyeonggi-do (KR)

(72) Inventor: Jeong-Hwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 210 days.

(21) Appl. No.: 15/167,969

(22) Filed: May 27, 2016

(65) Prior Publication Data

US 2017/0039933 A1 Feb. 9, 2017

(30) Foreign Application Priority Data

Aug. 5, 2015 (KR) ..... 10-2015-0110584

(51) Int. Cl.
*G09G 3/3208* (2016.01)

(52) U.S. Cl.
CPC ..... *G09G 3/3208* (2013.01); *G09G 2320/045* (2013.01)

(58) Field of Classification Search
CPC ..... G09G 3/3208; G09G 2320/045
See application file for complete search history.

(56) References Cited

U.S. PATENT DOCUMENTS

| | | | | |
|---|---|---|---|---|
| 6,995,519 | B2 | 2/2006 | Arnold et al. | |
| 7,161,566 | B2 | 1/2007 | Cok et al. | |
| 7,224,332 | B2 | 5/2007 | Cok | |
| 7,245,277 | B2 | 7/2007 | Ishizuka | |
| 7,924,249 | B2 | 4/2011 | Nathan et al. | |
| 8,115,707 | B2 | 2/2012 | Nathan et al. | |
| 2005/0110728 | A1 | 5/2005 | Cok | |
| 2007/0008251 | A1* | 1/2007 | Kohno | G09G 3/3233 345/76 |
| 2010/0225634 | A1* | 9/2010 | Levey | G09G 3/3208 345/212 |
| 2013/0050292 | A1* | 2/2013 | Mizukoshi | G09G 3/3291 345/690 |
| 2015/0103062 | A1* | 4/2015 | Kwon | G09G 3/3291 345/212 |

FOREIGN PATENT DOCUMENTS

| | | |
|---|---|---|
| KR | 10-2006-0073696 | 6/2006 |
| KR | 10-2011-0124655 | 11/2011 |
| KR | 10-2011-0124656 | 11/2011 |

* cited by examiner

*Primary Examiner* — Kwang-Su Yang
(74) *Attorney, Agent, or Firm* — Lewis Roca Rothgerber Christie LLP

(57) ABSTRACT

An organic light emitting display device includes a display panel including a pixel at a crossing region of a scan line, a data line, and a feedback line, a data driver sequentially providing reference signals to the pixel through the data line, a sensing driver sequentially sensing feedback signals flowing through the feedback line in response to the reference signals, and a timing controller modeling a current-voltage characteristic of the pixel based on the feedback signals.

16 Claims, 11 Drawing Sheets

ORGANIC LIGHT EMITTING DISPLAY DEVICE FOR COMPENSATING DEGRADATION OF A PIXEL AND METHOD OF DRIVING THE SAME

CROSS-REFERENCE TO RELATED APPLICATION

This application claims priority to, and the benefit of, Korean Patent Application No. 10-2015-0110584, filed on Aug. 5, 2015 in the Korean Intellectual Property Office (KIPO), the contents of which are incorporated herein in their entirety by reference.

BACKGROUND

1. Field

Embodiments of the present invention relate to a display device, and more particularly, to an organic light emitting display device that can compensate degradation of a pixel, and a method of driving the organic light emitting display device.

2. Description of the Related Art

An organic light emitting display device displays an image using an organic light emitting diode. The organic light emitting diode and/or a driving transistor, which transfers a current to the organic light emitting diode, may degrade as the organic light emitting diode (or the driving transistor) operates. The organic light emitting display device might not display an image with desired luminance due to degradation of the organic light emitting diode and/or degradation of the driving transistor (i.e., referred to as "degradation of a pixel").

A typical organic light emitting display device provides a reference voltage to pixels, measures a current flowing through each of the pixels in response to the reference voltage, and calculates an amount of degradation by comparing measured currents between adjacent pixels. For example, the typical organic light emitting display device sets a baseline (or a reference line) by connecting a current, which is measured at a first pixel among pixels in a degradation area of a display panel, and a current that is measured at a last pixel among the pixels in the degradation area of the display panel, and calculates degradation current for each of the pixels based on the baseline. However, the baseline may include an error due to characteristic dispersion of the pixels, and thus, the degradation current calculated based on the baseline may also include an error. Therefore, the degradation of the pixel may be inaccurately compensated.

SUMMARY

Embodiments of the present invention provide an organic light emitting display device that can accurately compensate degradation of a pixel by reflecting characteristic dispersion of pixels. Other embodiments of the present invention provide a method of driving the organic light emitting display device.

According to example embodiments, an organic light emitting display device may include a display panel including a pixel coupled to a data line and a feedback line, a data driver to provide reference signals to the pixel through the data line, a sensing driver to sense feedback signals through the feedback line in response to the reference signals, and a timing controller to model a current-voltage characteristic of the pixel based on the feedback signals.

In example embodiments, the timing controller may calculate a current-voltage change-ratio of the pixel may represent a ratio of a change of the feedback signals to a change of the reference signals based on a first feedback signal and a second feedback signal of the feedback signals, and the sensing driver may sense the first feedback signal in response to a first reference signal of the reference signals, and may sense the second feedback signal in response to a second reference signal of the reference signals.

In example embodiments, the timing controller may calculate a gain representing a ratio of the current-voltage change-ratio of the pixel to a reference current-voltage change-ratio of a reference pixel.

In example embodiments, the timing controller may calculate an offset value representing a difference between the current-voltage characteristic of the pixel and a reference current-voltage characteristic of the reference pixel.

In example embodiments, the timing controller may include a memory device that stores the gain and the offset value.

In example embodiments, each of the feedback signals may include a current value of a current flowing through the feedback line in response to each of the reference signals.

In example embodiments, the timing controller may model the current-voltage characteristic during an initial driving phase of the organic light emitting display device.

In example embodiments, the timing controller may accumulate input data and may model the current-voltage characteristic when accumulated input data exceeds a reference value.

In example embodiments, the display panel may include a first pixel, a second pixel, and a third pixel, and the timing controller may model a first current-voltage characteristic of the first pixel and a second current-voltage characteristic of the second pixel and may store the first current-voltage characteristic and the second current-voltage characteristic.

In example embodiments, the timing controller may calculate a third current-voltage characteristic of the third pixel based on the first current-voltage characteristic and the second current-voltage characteristic.

In example embodiments, the timing controller may determine the first pixel and the second pixel based on a characteristic dispersion of the display panel.

According to example embodiments, an organic light emitting display device may include a display panel including a pixel coupled to a data line and a feedback line, a data driver to provide a reference signal to the pixel through the data line, a sensing driver to sense a feedback signal through the feedback line in response to the reference signal, and a timing controller to compensate input data based on the feedback signal and based on a current-voltage characteristic of the pixel.

In example embodiments, the current-voltage characteristic may include a gain and an offset value, the gain may represent a ratio of a current-voltage change-ratio of the pixel to a reference current-voltage change-ratio of a reference pixel, and the offset value may represent a difference between the current-voltage characteristic of the pixel and a reference current-voltage characteristic of the reference pixel.

In example embodiments, the timing controller may compensate the feedback signal based on the gain and based on the offset value of the pixel.

In example embodiments, the timing controller may calculate a degradation current of the pixel based on a compensated feedback signal and may compensate the input data based on the degradation current.

In example embodiments, the display panel may include a first pixel, a second pixel, and a third pixel, and the timing controller may calculate a third current-voltage characteristic of the third pixel based on a first current-voltage characteristic of the first pixel and a second current-voltage characteristic of the second pixel.

According to example embodiments, a method of driving an organic light emitting display device including a pixel coupled to a data line and a feedback line, the method may include providing reference signals to the pixel through the data line, sensing feedback signals through the feedback line in response to the reference signals, and modeling a current-voltage characteristic of the pixel based on the feedback signals.

In example embodiments, modeling the characteristic of the pixel may include calculating a current-voltage change-ratio of the pixel representing a ratio of a change of the feedback signals to a change of the reference signals based on a first feedback signal of the feedback signals in response to a first reference signal of the reference signals, and based on a second feedback signal of the feedback signals in response to a second reference signal of the reference signals, calculating a gain representing a ratio of the current-voltage change-ratio of the pixel to a reference current-voltage change-ratio of a reference pixel, calculating an offset value representing a difference between the current-voltage characteristic of the pixel and a reference current-voltage characteristic of the reference pixel, and storing the gain and the offset value in a memory device.

In example embodiments, the method may further include sensing a third feedback signal through the feedback line in response to a third reference signal of the reference signals, and generating compensation data by compensating input data based on the gain, the offset value, and the third feedback signal.

In example embodiments, the generating the compensation data may include compensating the third feedback signal based on the gain and the offset value, calculating a degradation current of the pixel based on a compensated third feedback signal, and compensating the input data based on the degradation current.

According to the above, an organic light emitting display device according to example embodiments may improve accuracy of compensating degradation of a pixel based on a compensated sensing signal by sequentially providing reference signals to pixels, by sensing feedback signals that flows through the pixels in response to the reference signals, by modeling a current-voltage characteristic of the pixels based on the feedback signals, and by compensating a sensing signal, which is measured to compensate degradation of the pixels, based on a modeled current-voltage characteristic of the pixels.

In addition, a method of driving an organic light emitting display device according to example embodiments may effectively drive the organic light emitting display device.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
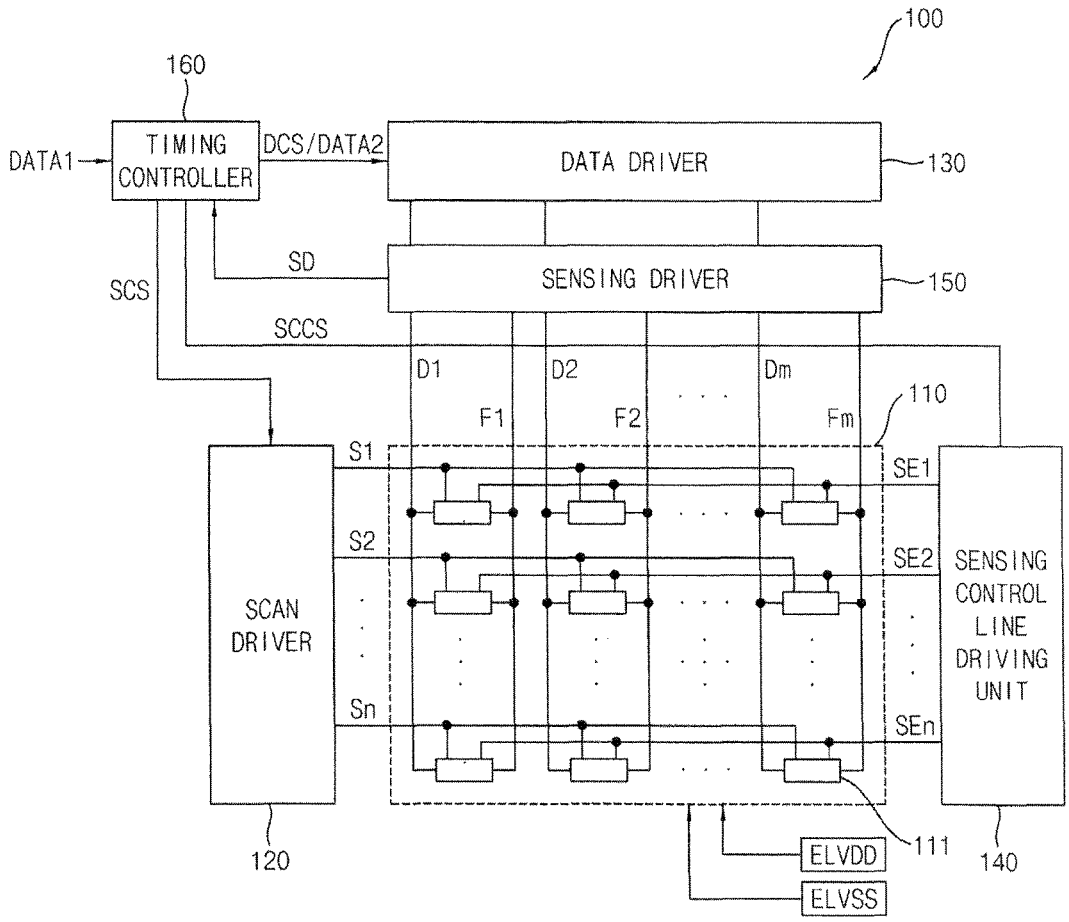
FIG. 1 is a block diagram illustrating an organic light emitting display device according to example embodiments.

Hereinafter, the present inventive concept will be explained in detail with reference to the accompanying drawings.

It will be understood that, although the terms "first", "second", "third", etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer, or section discussed below could be termed a second element, component, region, layer, or section, without departing from the spirit and scope of the present invention.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items.

Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

A person of skill in the art should also recognize that the process may be executed via hardware, firmware (e.g. via an ASIC), or in any combination of software, firmware, and/or hardware. Furthermore, the sequence of steps of the process is not fixed, but can be altered into any desired sequence as recognized by a person of skill in the art. The altered sequence may include all of the steps or a portion of the steps.

A relevant device or component (or relevant devices or components) according to embodiments of the present invention described herein may be implemented utilizing any suitable hardware, firmware (e.g. an application-specific integrated circuit), software, or a suitable combination of software, firmware, and hardware. For example, the various components of the relevant device(s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

FIG. 1 is a block diagram illustrating an organic light emitting display device according to example embodiments.

Referring to FIG. 1, the organic light emitting display device 100 may include a display panel 110, a scan driver 120, a data driver 130, a sensing control line driving unit 140 (e.g., a sensing control line driver 140), a sensing driver 150 (e.g., a sensing unit 150), and a timing controller 160. The organic light emitting display device 100 may display an image based on externally provided image data (e.g., input data DATA1).

The display panel 110 may include scan lines S1 through Sn, data lines D1 through Dm, sensing control lines SE1 through SEn, feedback lines F1 through Fm, and pixels 111, where each of m and n is an integer greater than or equal to 2. The pixels 111 may be respectively at crossing regions of the scan lines S1 through Sn, the data lines D1 through Dm, the sensing control lines SE1 through SEn, and the feedback lines F1 through Fm.

Each of the pixels 111 may store a data signal in response to a scan signal, and may emit light based on a stored data signal. A configuration of the pixels 111 will be described in detail with reference to FIG. 2.

The scan driver 120 may generate scan signals based on a scan driving control signal SCS. The scan driving control signal SCS may be provided from the timing controller 160 to the scan driver 120. The scan driving control signal SCS may include a start pulse and clock signals, and the scan driver 120 may include a shift register for sequentially generating the scan signal based on the start pulse and the clock signals.

The data driver 130 may generate data signals based on a data driving control signal DCS and based on image data (e.g., a second data DATA2). The data driver 130 may provide the display panel 110 with the data signal generated in response to the data driving control signal DCS. That is, the data driver 130 may provide the data signal to the pixels 111 through the data lines D1 through Dm. The data driving control signal DCS may be provided from the timing controller 160 to the data driver 130.

In some example embodiments, the data driver 130 may sequentially provide reference signals to the pixels 111 through the data lines D1 through Dm during a sensing period. That is, the data driver 130 may initialize the pixels 111 using the reference signals. Here, the reference signals may be voltages for sensing (e.g., voltages that are predetermined or pre-set for sensing) a characteristic (e.g., a current-voltage characteristic) of each of the pixels 111. The reference signals may be voltages close to an operation voltage (e.g., an operation point) of the pixels 111. For example, a current-voltage characteristic curve of an organic light emitting diode included in the pixels 111 may include at least one linear region (or a region having a substantially linear gradient), and the reference signals may include a voltage at a start point of the at least one linear region, and may include a voltage at an end point of the at least one linear region.

The sensing control line driving unit 140 may generate a sensing control signal in response to a sensing control line driving control signal SCCS. The sensing control line driving control signal SCCS may be provided from the timing controller 160 to the sensing control line driving unit 140.

The sensing driver 150 may sequentially sense (e.g., measure or detect) feedback signals feedbacked through the feedback lines F1 through Fm in response to the reference signals. Here, each of the feedback signals may be a current flowing through the feedback lines F1 through Fm in response to the reference signals. For example, the sensing driver 150 may sense a current through an organic light emitting diode and a feedback line (e.g., one of the feedback lines F1 through Fm) in response to a first reference signal supplied to a certain pixel. Here, the sensing driver 150 may generate a first sensing signal SD based on a sensed current (e.g., a first sensing current). For example, the sensing driver 150 may calculate a first voltage difference between a sensed current (e.g., a first sensing current) and a first setting voltage, which may be pre-stored or predetermined, and may generate the first voltage difference as the first sensing signal SD.

A configuration of the sensing driver 150 will be described in detail hereinafter with reference to FIG. 3.

The timing controller 160 may control the scan driver 120, the data driver 130, the sensing control line driving unit 140, and the sensing driver 150. The timing controller 160 may generate the scan driving control signal SCS, the data driving control signal DCS, the sensing control line driving control signal SCCS, and the sensing control signal, and may control the scan driver 120, the data driver 130, the sensing control line driving unit 140, and the sensing driver 150 based on generated signals.

In some example embodiments, the timing controller 160 may model a current-voltage characteristic of the pixel 111 based on the feedback signals. Here, the current-voltage characteristic may represent a relation between the data signal provided to the pixel 111 and a current flowing through the pixel (e.g., a current flowing through an organic light emitting diode of the pixel 111). The current-voltage characteristic may be represented as a first linear equation.

In an example embodiment, the timing controller 160 may calculate a current-voltage change-ratio of the pixel 111 based on a first feedback signal and a second feedback signal. Here, the first feedback signal may be sensed at the feedback line in response to a first reference signal of the reference signals, and the second feedback signal may be sensed at the feedback line in response to a second reference signal of the reference signals. For example, the timing controller 160 may calculate a voltage difference (e.g., $\Delta V$) between the first reference signal and the second reference signal, may calculate a current difference (e.g., $\Delta I$) between the first feedback signal and the second feedback signal, and may calculate a ratio (i.e., the current-voltage change-ratio) of a change of the feedback signals (e.g., a current change, or $\Delta I$) to a change of the reference signals (e.g., a voltage change, or $\Delta V$) based on the voltage difference and the current difference. When the current-voltage characteristic is represented as the first linear equation, the timing controller 160 may calculate a gradient of the first linear equation.

In some example embodiments, the timing controller 160 may calculate a gain that represents a ratio of the current-voltage change-ratio, which is calculated, to a reference current-voltage change-ratio, which may be predetermined or pre-set. The timing controller 160 may also calculate an offset value that represents a difference between the first feedback signal and a reference feedback signal, which may be predetermined. For example, when the current-voltage characteristic of the pixel 111 is represented as the first linear equation, the timing controller 160 may calculate the gain (e.g., a ratio of gradients) and the offset value (e.g., a ratio of constants) to convert a first linear equation that is calculated into a first linear equation, which may be predetermined. A configuration of calculating the gain and the offset value will be described in detail with reference to FIGS. 4 and 5.

In some example embodiments, the timing controller 160 may store the gain and the offset value.

In an example embodiment, the timing controller 160 may model the current-voltage characteristic of the pixel 111 in a manufacturing process of the organic light emitting display device 100. That is, the timing controller 160 may calculate the gain and the offset value in the manufacturing process of the organic light emitting display device 100, and may store the gain that is calculated and the offset value that is calculated.

In an example embodiment, the timing controller 160 may model the current-voltage characteristic of the pixel 111 during an initial driving phase (or an initial driving period) of the organic light emitting display device 100. For example, the timing controller 160 may model the current-voltage characteristic of the pixel 111 when power is supplied to the organic light emitting display device 100.

In an example embodiment, the timing controller 160 may model the current-voltage characteristic of the pixel 111 for every event. For example, the timing controller 160 may model the current-voltage characteristic of the pixel 111 with a certain period repeatedly. For example, the timing controller 160 may accumulate input data and may model the current-voltage characteristic of the pixel 111 when accumulated input data exceeds a reference value.

In some example embodiments, the timing controller 160 may compensate input data based on the current-voltage characteristic and based on a sensing signal (or a feedback sensing signal). Here, the sensing signal (or the feedback sensing signal) may be substantially the same as, or similar to, the feedback signals described above, with the exception of a sensing time. That is, the feedback signals may be sensed at a time when the current-voltage characteristic is modeled, and the sensing signal (or the feedback sensing signal) may be sensed at a time of degradation compensation. For example, the feedback signals may be sensed in the manufacturing process of the organic light emitting display device 100, and the sensing signal (or the feedback sensing signal) may be sensed in a degradation compensation process.

In an example embodiment, the timing controller 160 may compensate the sensing signal (or the feedback sensing signal) based on the gain and the offset value of the pixel 111, may calculate a degradation current of the pixel 111 based on a compensated feedback signal, and may compensate the input data based on the degradation current.

The organic light emitting display device 100 may further include a power supplier. The power supplier may generate driving voltages to drive the organic light emitting display device 100. The driving voltages may include a first power voltage ELVDD and a second power voltage ELVSS. The first power voltage ELVDD may be greater than the second power voltage ELVSS.

As described above, the organic light emitting display device according to example embodiments may provide reference signals to the pixel 111, may sense feedback signals that are feedbacked in response to the reference signals, and may model the current-voltage characteristic of the pixel 111 based on the feedback signals (i.e., the organic light emitting display device 100 may calculate and store the gain and the offset value of the pixel 111). In addition, the organic light emitting display device 100 may compensate a sensing signal (or a feedback sensing signal), sensed for degradation compensation, based on the current-voltage characteristic of the pixel 111. Therefore, the organic light emitting display device 100 may improve accuracy of degradation compensation by performing the degradation compensation based on a compensated feedback signal (or a compensated sensing signal).

Figure 2:
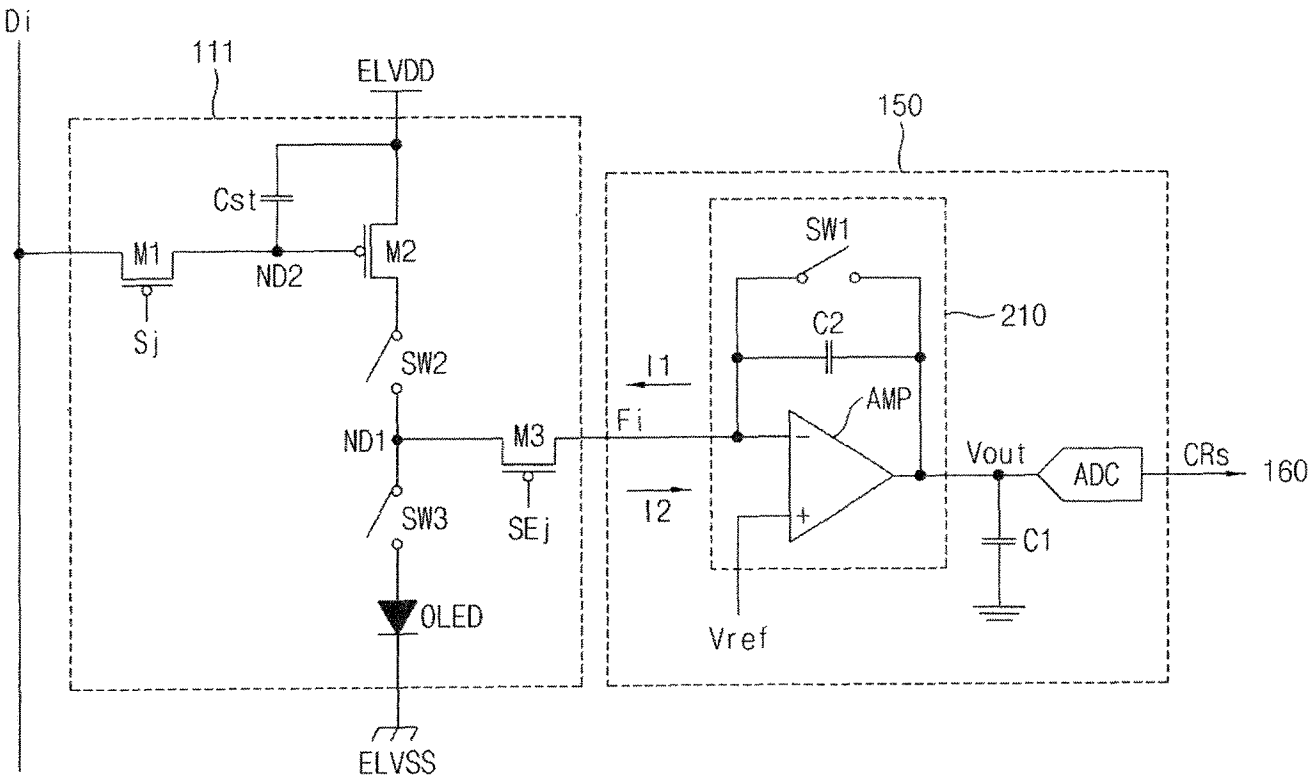
FIG. 2 is a circuit diagram illustrating an example of a pixel and a sensing driver included in the organic light emitting display device of FIG. 1.

FIG. 2 is a circuit diagram illustrating an example of a pixel and a sensing driver included in the organic light emitting display device of FIG. 1.

Referring to FIG. 2, the pixel 111 may include a switching transistor M1, a storage capacitor Cst, a driving transistor M2, an organic light emitting diode OLED, and a sensing transistor M3. The pixel 111 may be electrically connected between an (i)th data line Di and an (i)th feedback line Fi, where i is a positive integer.

The switching transistor M1 may be electrically connected between the (i)th data line Di and a second node ND2 and may be turned on in response to a scan signal Sj. The storage capacitor Cst may be electrically connected between the first power voltage ELVDD and the second node ND2. When the switching transistor M1 is turned on, the storage capacitor Cst may be charged with the data signal provided through the (i)th data line Di. The driving transistor M2 may transfer the organic light emitting diode OLED with a driving current in response to a stored voltage (i.e., the data signal) in the storage capacitor Cst. The organic light emitting diode OLED may be electrically connected between a first node ND1 and the second power voltage ELVSS, and may emit light in response to the driving current. The sensing transistor M3 may be electrically connected between the (i)th feedback line Fi and the first node ND1, and may be turned on in response to the sensing control signal SEj.

In some example embodiments, the pixel 111 may further include a second switch SW2 and a third switch SW3. The second switch SW2 may be electrically connected between the driving transistor M2 and the first node ND1, and may be turned off during the first sensing period. Here, the first sensing period may be a period for sensing degradation information of the organic light emitting diode OLED. In the first sensing period, the second switch SW2 may be turned off, the third switch SW3 may be turned on, and the sensing transistor M3 may be turned on. Here, a current path is formed between the sensing driver 150 and the second power voltage ELVSS, and a first sensing current I1 may flow through the feedback line Fi (i.e., the first sensing current I1 may flow from the sensing driver 150 through the first node ND1 to the second power voltage ELVSS).

The third switch SW3 may be electrically connected between the first node ND1 and the organic light emitting diode OLED, and may be turned off during the second sensing period, which may be a period for sensing a threshold voltage/mobility of the driving transistor M2. In the second sensing period, the second switch SW2 may be turned on, the third switch SW3 may be turned off, and the sensing transistor M3 may be turned on. Here, a current path may be formed between the first power voltage ELVDD and the sensing driver 150, and a second sensing current I2 may flow through the feedback line Fi (i.e., the second sensing current I2 may flow from the first power voltage ELVDD through the first node ND1 to the sensing driver 150).

The pixel 111 is illustrated by way of example in FIG. 2, and the present invention is not limited thereto. For example, the pixel may omit the feedback line Fi, and may use the data line Di as a feedback line.

The sensing driver 150 may include an integrator 210, a convertor ADC, and a memory device.

The integrator 210 may integrate a sensing current (e.g., the first sensing current I1 or the second sensing current I2) flowing through the (i)th feedback line Fi according to the reference voltage Vref, and may output an output voltage Vout generated by integration. The integrator 210 may include an amplifier AMP and a second capacitor C2. The amplifier AMP may include a first input terminal electrically connected to the (i)th feedback line Fi, a second terminal for receiving the reference voltage Vref, and an output terminal that is electrically connected to the converter ADC. The second capacitor C2 may be electrically connected between the first input terminal of the amplifier AMP and the output terminal of the amplifier AMP.

The integrator 210 may integrate the first sensing current I1 provided to the pixel 111 through the (i)th feedback line Fi in the first sensing period. Here, the integrator 210 may operate as a current source. The integrator 210 may integrate the second sensing current I2 provided from the pixel 111 through the (i)th feedback line Fi in the second sensing period.

In an example embodiment, the integrator 210 may further include a first switch SW1 that is electrically connected between the first input terminal of the amplifier AMP and the output terminal of the amplifier AMP. The first switch SW1 may be turned on during a reset period. The first switch SW1 may be used to reset (or initialize) the integrator 210 during the reset period (i.e., the first switch SW1 may be closed, or turned on, to discharge a stored voltage in the second capacitor C2 during the reset period).

In an example embodiment, the sensing driver 150 may further include a first capacitor C1 that temporarily stores the output voltage Vout of the integrator 210. The first capacitor C1 may be electrically connected between the output terminal of the amplifier AMP and ground (which may be equal to the reference voltage Vref), and may store the output voltage Vout temporarily during the first sensing period or the second sensing period.

The converter ADC may generate sensing data based on the output voltage Vout of the integrator 210. For example, the converter ADC may include a comparator that compares the output voltage Vout of the integrator 210 and a setting voltage (or the reference voltage Vref).

The sensing driver 150 is illustrated by way of example in FIG. 2. The sensing driver 150 is not limited thereto. For example, the sensing driver 150 may provide a reference current (or a sensing current) to the pixel 111, may sense a node voltage at the first node ND1, and may generate a sensing data based on the node voltage.

Figure 3:
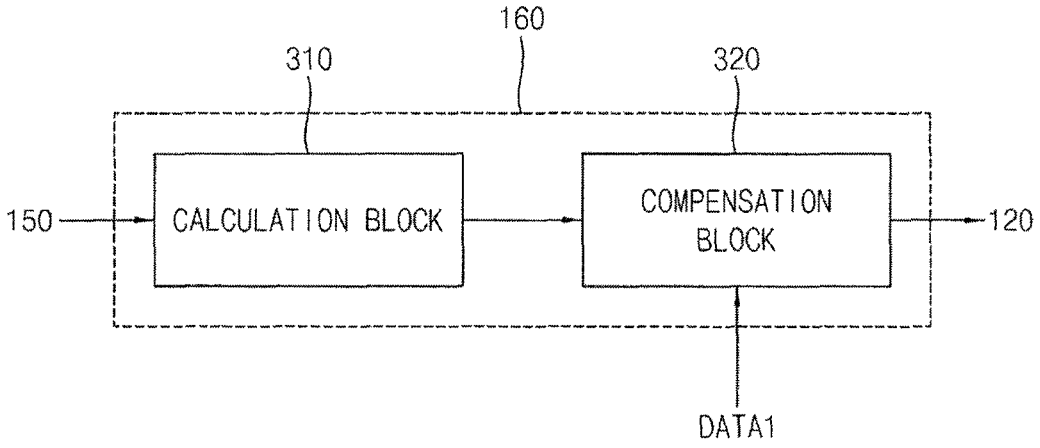
FIG. 3 is a block diagram illustrating an example of a timing controller included in the organic light emitting display device of FIG. 1.
Figure 4:
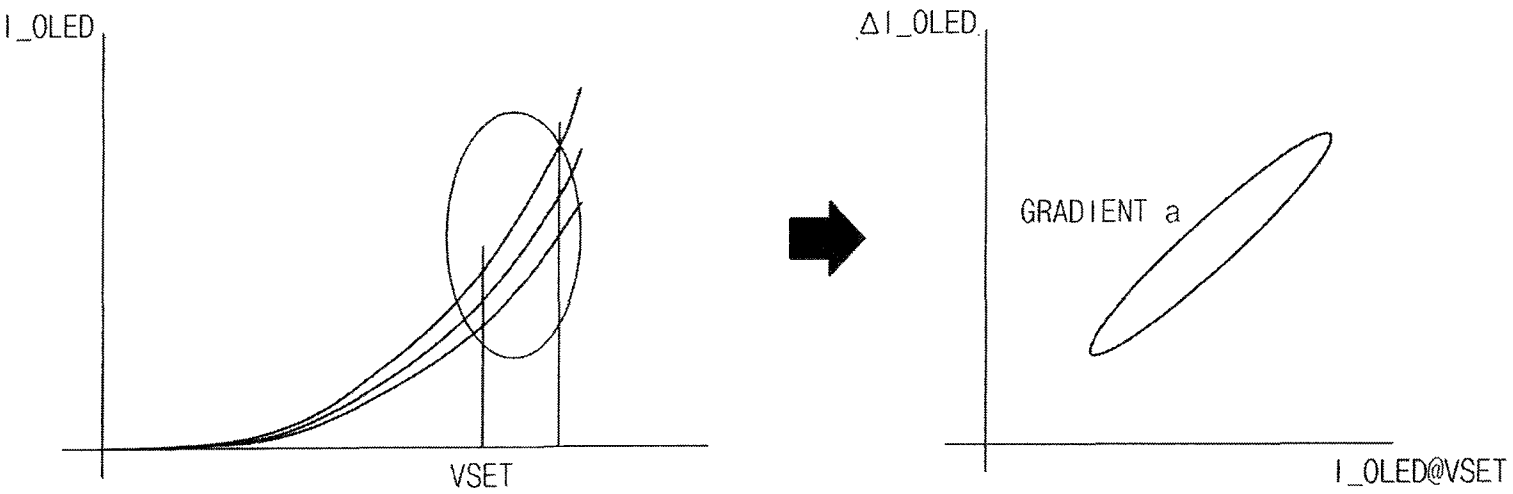
FIG. 4 is a diagram illustrating an example of a current-voltage characteristic curve generated by the timing controller of FIG. 3.
Figure 5:
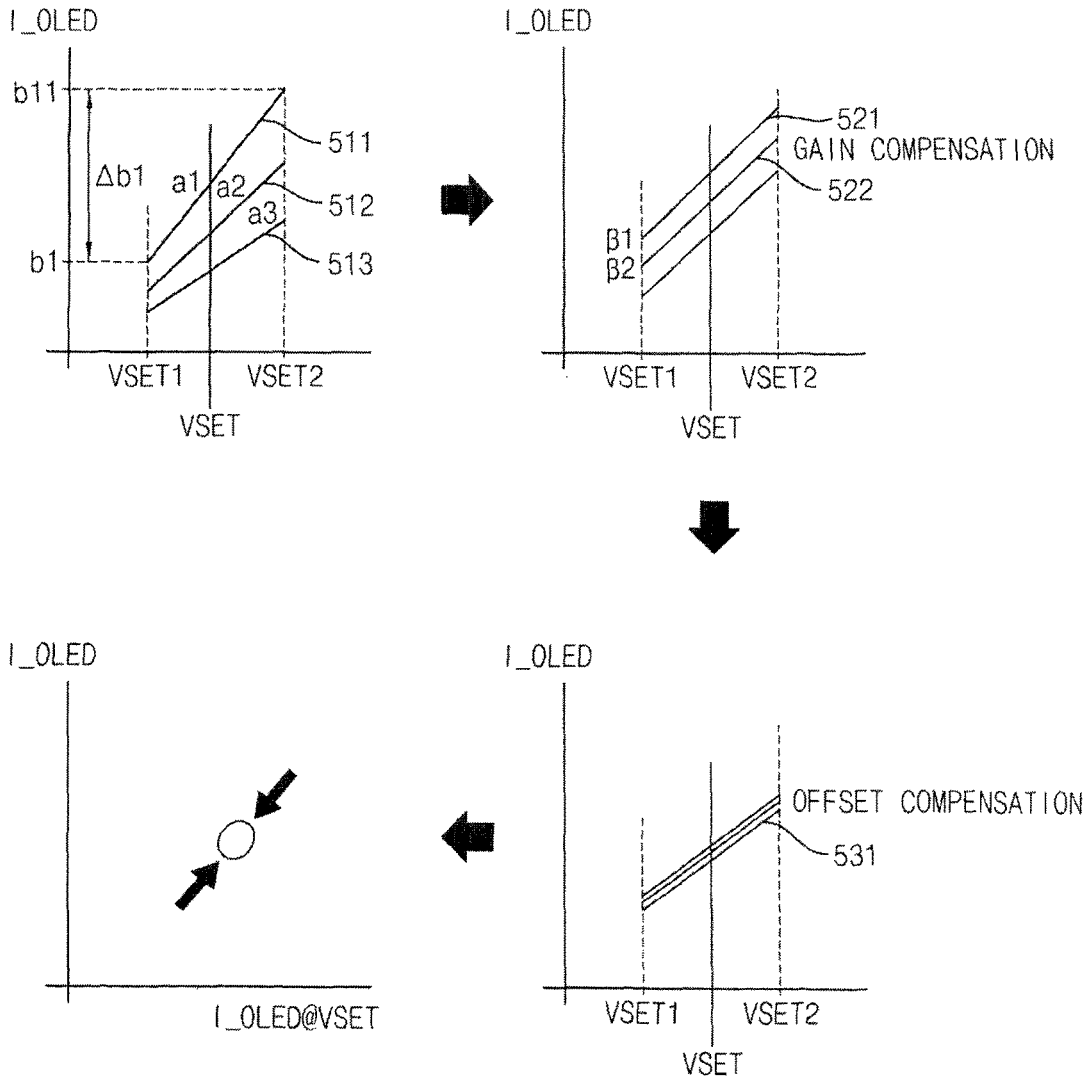
FIG. 5 is a diagram illustrating another example of a current-voltage characteristic curve generated by the timing controller of FIG. 3.

FIG. 3 is a block diagram illustrating an example of a timing controller included in the organic light emitting display device of FIG. 1, FIG. 4 is a diagram illustrating an example of a current-voltage characteristic curve generated by the timing controller of FIG. 3, and FIG. 5 is a diagram illustrating another example of a current-voltage characteristic curve generated by the timing controller of FIG. 3.

Referring to FIG. 3, the timing controller 160 may include a calculation block 310 and compensation block 320. The calculation block 310 may model a current-voltage characteristic of the pixel 111 based on the feedback signals. The current-voltage characteristic may be represented as a first linear equation.

Referring to FIG. 4, current-voltage characteristic curves of pixels may be different from each other according to a characteristic dispersion (or a characteristic distribution) of the pixels. According to different current-voltage characteristic, currents (e.g., a current flowing through an organic light emitting diode of the pixel 111) sensed in response to a reference voltage VSET may be different from each other. For example, when the reference voltage VSET is provided to the pixels 111, currents I_OLED sensed at the pixel 111 may be different from each other. In addition, when the pixels 111 may be degraded (e.g., when the organic light emitting display device has been used for a certain amount of time), the sensing currents I_OLED may be different from each other, and degradation currents (i.e., a current presently sensed subtracted from a current sensed in the past) of the pixels 111 may also be different from each other.

Therefore, as illustrated in a right graph in FIG. 4, a current value I_OLED@VSET sensed based on the reference voltage VSET, and a degradation current ΔI_OLED, may be distributed in a certain region.

Referring again to FIG. 3, the calculation block 310 may model the pixels 111 having different current-voltage characteristics into a pixel (i.e., one pixel having one current-voltage characteristic).

Referring to FIG. 5, the calculation block 310 may perform a gain-compensation to the current-voltage characteristics of the pixels, and may perform an offset-compensation to gain-compensated current-voltage characteristics. Here, current-voltage characteristics that are gain-compensated and offset-compensated may have the same or substantially the same current-voltage characteristic. That is, current value I_OLED@VSET sensed based on the reference voltage VSET, and a degradation current ΔI_OLED, may be located at one point.

In some example embodiments, the calculation block 310 may calculate variables (e.g., a gain and an offset value for each pixel) to convert current-voltage characteristics of the pixels into a current-voltage characteristic.

The calculation block 310 may calculate a current-voltage change-ratio of the pixel 111 based on a first feedback signal and a second feedback signal. For example, the calculation block 310 may calculate a ratio of a current change to a voltage change (i.e., the current-voltage change-ratio) based on a voltage difference between a first reference signal VSET1 and a second reference signal VSET2 (e.g., ΔV), and based on a current difference Δb1 between the first feedback signal b1 and the second feedback signal b11. As illustrated in FIG. 5, the calculation block 310 may calculate a first gradient a1 of a first current-voltage characteristic curve 511. Similarly, the calculation block 310 may calculate a second gradient a2 of a second current-voltage characteristic curve 512, and may also calculate a third gradient a3 of a third current-voltage characteristic curve 513. That is, the calculation block 310 may calculate a gradient of a current-voltage characteristic curve of each of the pixels 111.

The current-voltage characteristic curve calculated by the calculation block 310 may be represented as a first linear equation (e.g., Equation 1 below).

$$Ii = ai * \Delta VSET + bi \qquad \text{Equation 1}$$

where, Ii denotes a feedback signal sensed at an (i)th pixel, ΔVSET denotes a change of a reference signal (or a change of a reference voltage), ai denotes a constant, and bi denotes a constant.

In an example embodiment, the calculation block 310 may calculate a gain that represents a ratio of the current-voltage change-ratio of the pixel 111 to a reference current-voltage change-ratio, which may be predetermined. For example, the second gradient a2 of the second current-voltage characteristic curve 512 is determined as a reference gradient (i.e., the reference current-voltage change-ratio), the calculation block 310 may calculate a first gain that represents a ratio of the first gradient a1 to the second gradient a2. Here, the first gain may be a1/a2 (i.e., the first gradient over the second gradient). The calculation block 310 may calculate a gain for each of the pixels 111.

A first current-voltage characteristic curve 521 that is gain-compensated may be represented as a [Equation 2] bellow.

$$\begin{aligned} I1_comp1 &= gain1 * I1 = gain1 * (a1 * \Delta VSET + b1) \\ &= a2 * \Delta VSET + (a1 * b1/a2) \end{aligned} \qquad \text{Equation 2}$$

where I1_comp1 denotes the first current-voltage characteristic curve that is gain-compensated.

In an example embodiment, the calculation block 310 may calculate an offset value that represents a difference between the first feedback signal and a reference feedback signal, which may be predetermined. That is, the offset value may be a difference between the reference current-voltage characteristic curve and a current-voltage characteristic curve of a certain pixel. For example, a feedback signal sensed based on a first reference signal VSET1 may be β1 in the first current-voltage characteristic curve 521 that is gain-compensated, and a feedback signal sensed based on a first reference signal VSET1 may be β2 in the second current-voltage characteristic curve 522 that is gain-compensated (i.e., the reference current-voltage characteristic curve). Here, the calculation block 310 may calculate a difference (β2−β1) between the feedback signals as a first offset value.

The first current-voltage characteristic curve 531 that is offset-compensated may be substantially the same as, or similar to, the reference current-voltage characteristic curve (e.g., the second current-voltage characteristic curve 512).

The calculation block 310 performs gain-compensation and offset-compensation to the current-voltage characteristic curve of the pixel 111, as sequentially illustrated in FIG. 5. However, the calculation block 310 is not limited thereto. For example, The calculation block 310 may sequentially perform offset-compensation and gain-compensation to the current-voltage characteristic curve of the pixel 111.

As described with reference to FIG. 5, the calculation block 310 may perform gain-compensation to the current-voltage characteristic of the pixels 111, and may perform offset-compensation to the current-voltage characteristic that is gain-compensated. Here, current-voltage characteristics that are gain-compensated and offset-compensated may have the same or substantially the same current-voltage characteristic. Therefore, the current I_OLED@VSET sensed based on the reference voltage VSET and the degradation current ΔI_OLED may be located at one point.

Referring again to FIG. 3, the calculation block 310 may store the gain and the offset value. In an example embodiment, the calculation block 310 may include a memory device, and may store the gain and the offset value in the memory device. As described with reference to FIG. 1, the calculation block 310 may model the current-voltage characteristics of the pixels 111 in a manufacturing process of the organic light emitting display device 100 and may store the current-voltage characteristics. For example, the calculation block 310 may calculate gains and offset values of the pixels 111 in the manufacturing process of the organic light emitting display device 100, and may store the gains and the offset values in the memory device based on the pixels 111.

In some example embodiments, the calculation block 310 may store only a few current-voltage characteristic to at least a few selected from pixels. For example, when the display panel 110 includes a first pixel, a second pixel, and a third pixel, the calculation block 310 may model a first current-voltage characteristic of the first pixel, may model a second current-voltage characteristic of the second pixel, and may store the first current-voltage characteristic and the second current-voltage characteristic, Here, the calculation block 310 might not store a third current-voltage characteristic of the third pixel. The calculation block 310 may calculate the third current-voltage characteristic of the third pixel based on the first current-voltage characteristic and the second current-voltage characteristic. A configuration of storing current-voltage characteristics of the pixels 111 will be described in detail with reference to FIG. 7.

The compensation block 320 may compensate input data DATA1 based on the current-voltage characteristic stored and sensing signals (or feedback sensing signals). Here, the feedback signals may be signals sensed at a degradation compensation time. For example, each of the feedback signals may be a sensing current (i.e., a current flowing through an organic light emitting display diode) of each of the pixels 111 in a sensing period among a driving period of the organic light emitting display device 100.

In an example embodiment, the compensation block 320 may compensate the feedback signals based on a gain and an offset value of each of the pixels, may calculate a degradation current of each of the pixels 111 based on compensated feedback signals, and may compensate the input data DATA1 based on the degradation current.

Figure 6A:
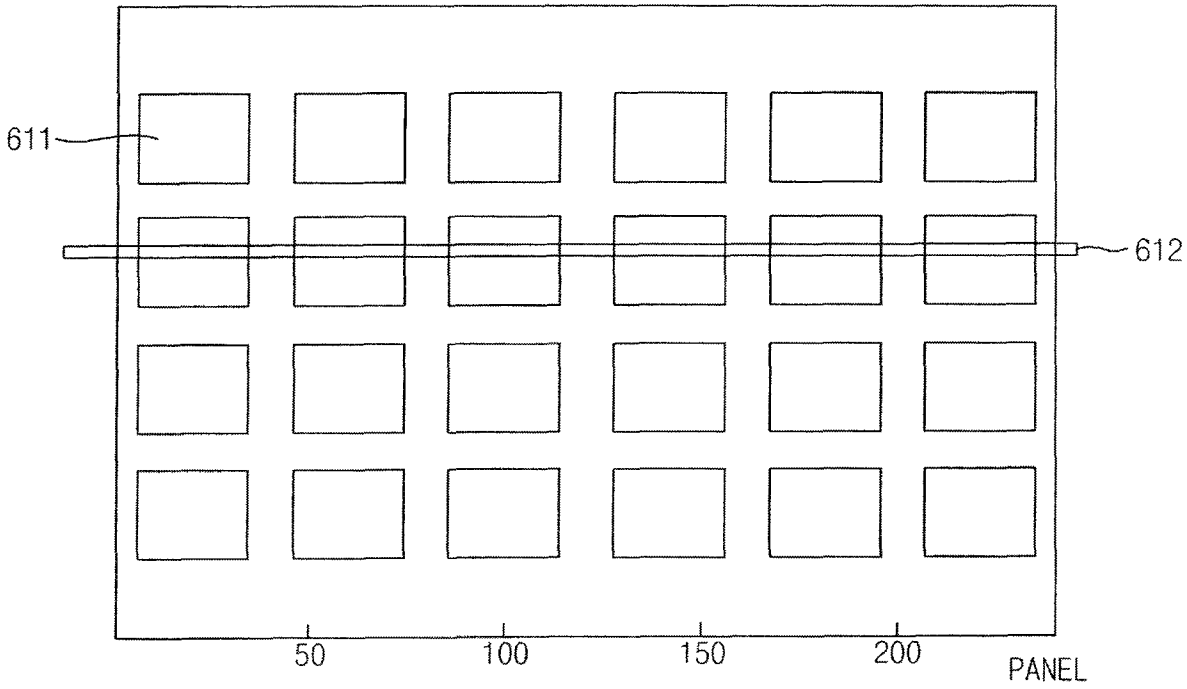
FIG. 6A is a diagram illustrating an example of a test image displayed on a display panel included in the organic light emitting display device of FIG. 1.
Figure 6B:
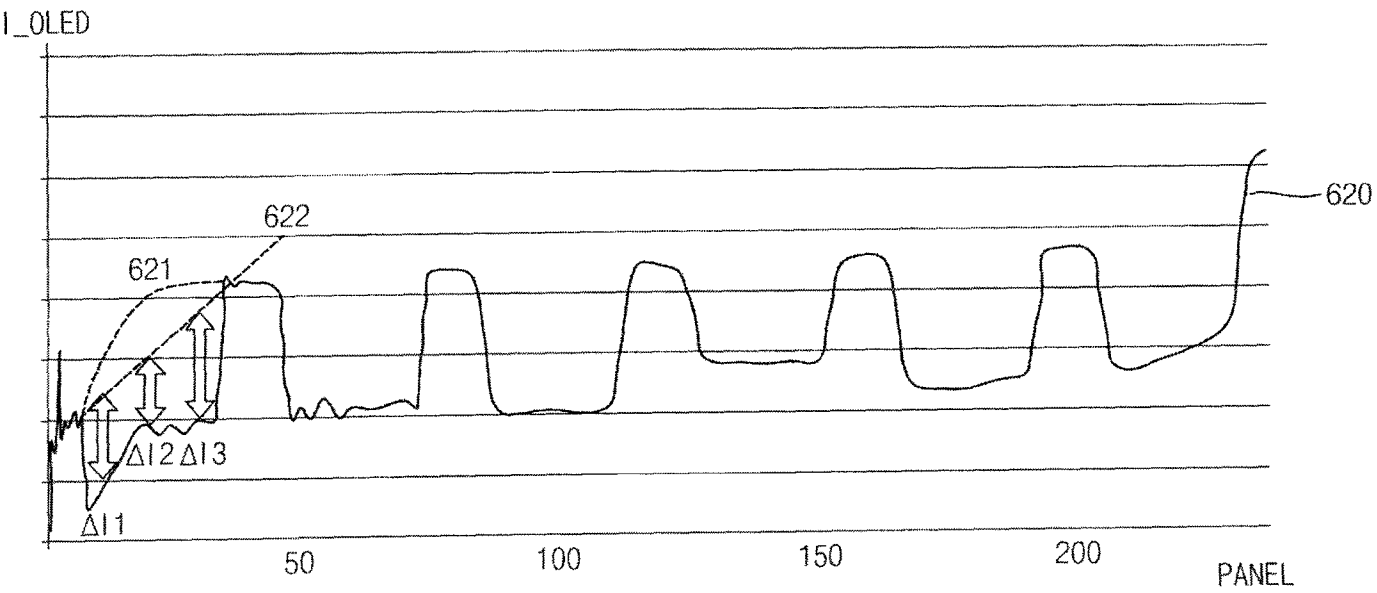
FIG. 6B is a waveform diagram illustrating an example of a feedback signal sensed by a sensing driver included in the organic light emitting display device of FIG. 1.
Figure 6C:
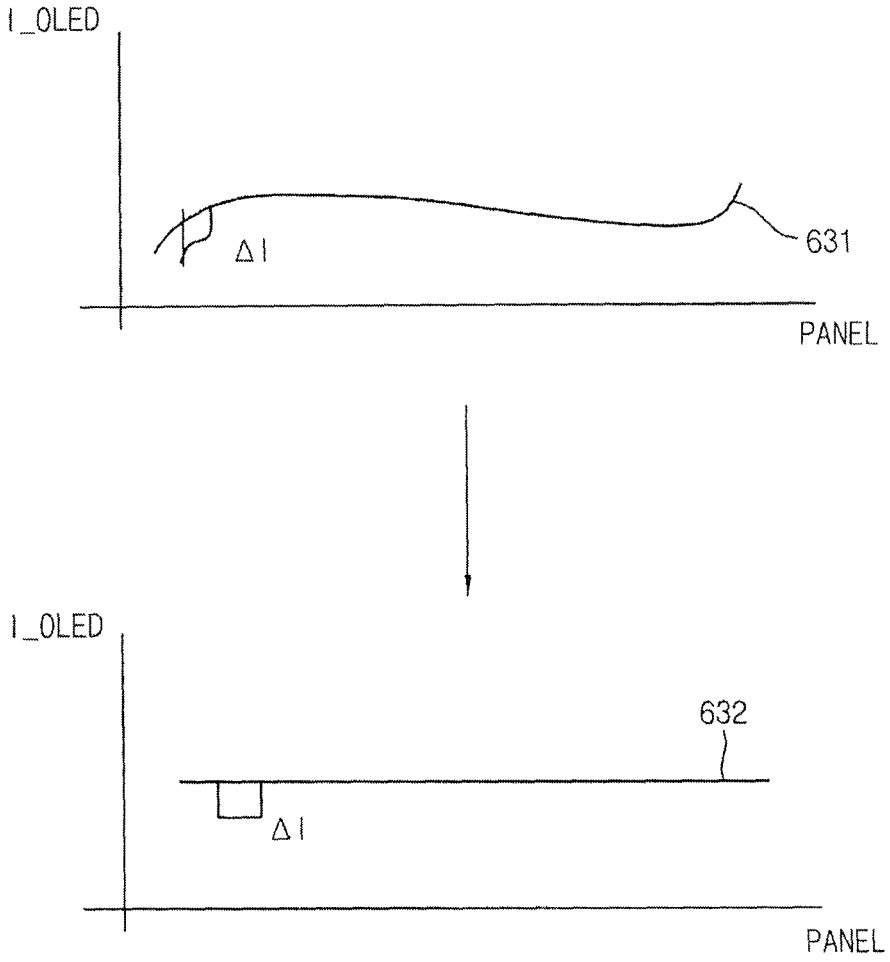
FIG. 6C is a diagram illustrating an example of a feedback signal compensated by the timing controller of FIG. 3.

FIG. 6A is a diagram illustrating an example of a test image displayed on the display panel 110 included in the organic light emitting display device 100 of FIG. 1, FIG. 6B is an waveform diagram illustrating an example of a feedback signal sensed by a sensing driver included in the organic light emitting display device of FIG. 1, and FIG. 6C is a diagram illustrating an example of a feedback signal compensated by the timing controller of FIG. 3.

Referring to FIGS. 1 and 6A, a test image displayed on the display panel 110 may include a degradation area 611. The degradation area 611 may be degraded (or deteriorated) by use. The degradation area 611 may be represented differently according to a pattern of the test image.

Referring to FIGS. 6A and 6B, the organic light emitting display device 100 may sense a feedback signal for each pixel row of the display panel 110. For example, the organic light emitting display device 100 may sense a current flowing through an organic light emitting diode for each pixel row of the display panel 110.

As illustrated in FIG. 6B, although the same or substantially the same reference voltage is supplied to a certain pixel row 612, sensed currents of pixels in the certain pixel row 612 may be different according to degradation of each of the pixels.

The organic light emitting display device 100 may calculate an amount of degradation by comparing sensed currents of the pixels 111 that are adjacent. The organic light emitting display device 100 may set (or determine) a baseline (or a reference line) 622 by connecting a sensed current of a first pixel of the pixels in the degradation area 611 and a sensed current of a last pixel of the pixels in the degradation area 611, and may calculate an amount of a degradation current (i.e., ΔI1, ΔI2, or ΔI3) of each of the pixels based on the baseline 622.

However, the baseline 622, determined in an area in which a characteristic dispersion is rapidly changed, may be different from a real baseline 621 (i.e., a current curve of pixels before the pixels is degraded). Therefore, an amount of a degradation current (e.g., ΔI2) calculated may be different from an amount of a real degradation current.

Referring to FIG. 6C, the organic light emitting display device 100 may compensate a sensed current signal 631 based on a current-voltage characteristic (i.e., a gain and an offset value) of each of the pixels 111 and may calculate an amount of a degradation current (e.g., ΔI1) of each of the pixels based on a compensated sensed current signal 632.

That is, the organic light emitting display device 100 may convert various suitable current-voltage characteristics of the pixels 111 into a current-voltage characteristic. Here, the organic light emitting display device 100 may use a gain and an offset value that are pre-stored based on the pixels 111.

The organic light emitting display device 100 may convert the sensed current signal 631 of the real baseline 621, which may be changed according to a location of the pixels 111, into the compensated sensed current signal 632 having a constant baseline based on the current-voltage characteristic curve (i.e., one current-voltage characteristic curve). Therefore, the organic light emitting display device 100 may calculate (e.g., exactly or precisely calculate) a degradation current ΔI of each of the pixel 111 based on the compensated sensed current signal 632 and may calculate an amount of degradation compensation based on the degradation current ΔI calculated.

Figure 7:
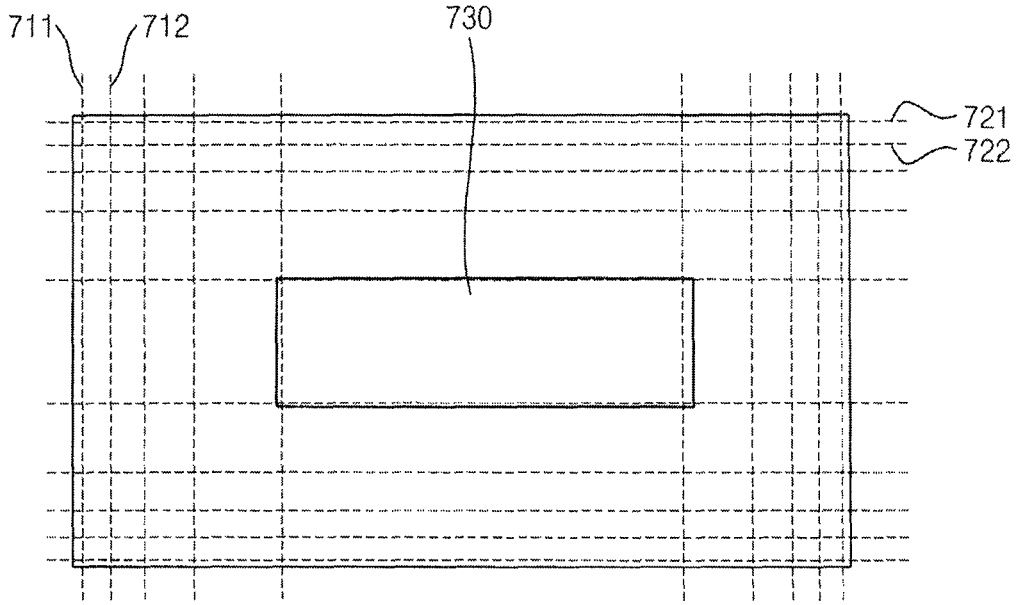
FIG. 7 is a diagram illustrating a display panel included in the organic light emitting display device of FIG. 1.

FIG. 7 is a diagram illustrating a display panel included in the organic light emitting display device of FIG. 1.

Referring to FIGS. 1 and 7, the display panel 110 may include pixel areas. Here, the pixel areas may be divided according to current-voltage characteristics of the pixels 111 included in the display panel 110. The pixels 111 included in a certain pixel area may have current-voltage characteristics that are substantially the same as or similar to each other. For example, pixels located between a first pixel column 711 and a second pixel column 712 may have current-voltage characteristics that are similar to each other. For example, pixels located between a first pixel row 721 and a second pixel row 722 may have current-voltage characteristic that are similar to each other.

In some example embodiments, the organic light emitting display device 100 may calculate and store current-voltage characteristics of pixels included in a characteristic calculation area of the display panel 110. For example, the organic light emitting display device 100 may calculate and store current-voltage characteristics of pixels included in columns and rows (e.g., predetermined columns and predetermined rows). The organic light emitting display device 100 may calculate and store gains and offset values of pixels included in the first pixel column 711, the second pixel column 712, the first pixel row 721, and the second pixel row 722. Current-voltage characteristics of certain pixels (i.e., pixels not included in the characteristic calculation area) that are not stored may calculated based on current-voltage characteristics of pixels that are spaced adjacent to the certain pixels. That is, the organic light emitting display device 100 may calculate current-voltage characteristics of the certain pixels based on the current-characteristics of the pixels that are spaced adjacent to the certain pixels. For example, a current-voltage characteristic of a third pixel, located between the first pixel column 711 and the second pixel column 712, may be calculated based on a current-voltage characteristic of a first pixel, which is located at a crossing region of the first pixel column 711 and the first pixel row 721, and a current-voltage characteristic of a second pixel, which is located at a crossing region of the first pixel row 721 and the second pixel column 712. For example, the organic light emitting display device 100 may calculate the current-voltage characteristic of the third pixel by interpolating the current-voltage characteristic of the first pixel and the current-voltage characteristic of the second pixel.

The pixel areas may be divided based on a characteristic dispersion of the pixels 111. For example, intervals between pixel rows and pixel columns, of which current-voltage characteristics are stored, may be narrowed at an area (i.e., a part of the display panel 110) in which a characteristic dispersion is rapidly changed. Therefore, intervals for storing a current-voltage characteristic (e.g., a gain and an offset value) of the pixels 111 may be narrowed. For example, intervals between the pixel rows and the pixel columns may be widened at an area (i.e., a part of the display panel 110) in which a characteristic dispersion is constant. Therefore, intervals for storing a current-voltage characteristic (e.g., a gain and an offset value) of the pixels 111 may be widened.

As described above, the organic light emitting display device 100 may store current-voltage characteristics (e.g., gains and offset values) of only a few of the pixels 111 in consideration of a characteristic dispersion of the pixels and may calculate current-voltage characteristics of the remaining among the pixels 111 based on stored current-voltage characteristics. Therefore, the organic light emitting display device 100 may reduce a size (or a capacity) of a memory device that stores a current-voltage characteristic of a pixel.

Figure 8:
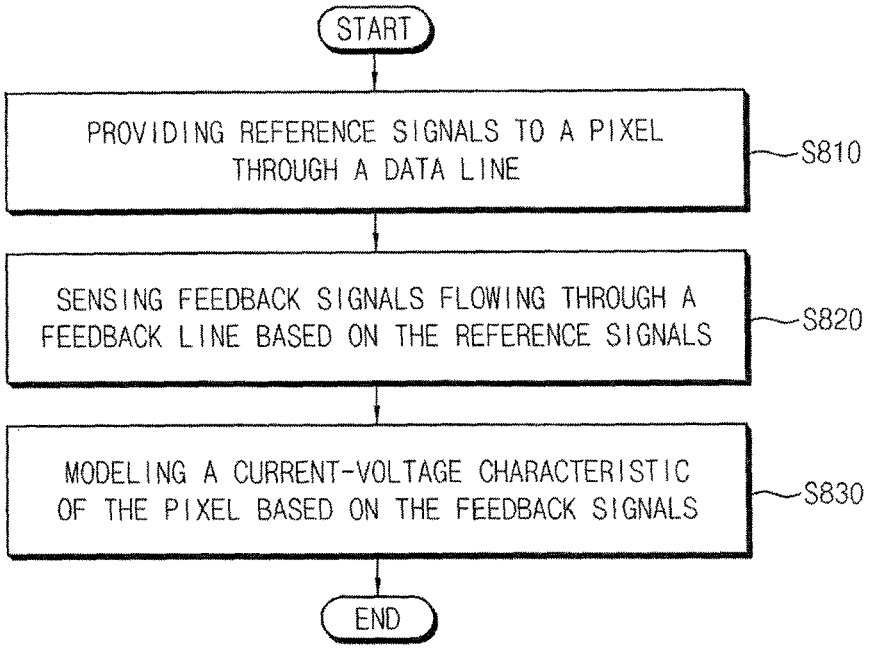
FIG. 8 is a flowchart illustrating a method of driving an organic light emitting display device according to example embodiments.

FIG. 8 is a flowchart illustrating a method of driving an organic light emitting display device according to example embodiments.

Referring to FIGS. 1 and 8, the method of FIG. 8 may drive the organic light emitting display device 100 that includes a pixel 111 at a crossing region of a data line, a feedback line, and a scan line.

The method of FIG. 8 may provide reference signals to the pixel through the data line, sequentially (S810).

The method of FIG. 8 may sense feedback signals that are feedbacked (or that flow) through the feedback line in response to the reference signals (S820). For example, the method of FIG. 8 may sense a first feedback current flowing through an organic light emitting diode and the feedback line based on a first reference signal, and may sense a second feedback current flowing through an organic light emitting diode and the feedback line based on a second reference signal.

The method of FIG. 8 may model a current-voltage characteristic of the pixel based on the feedback signals (S830).

Figure 9:
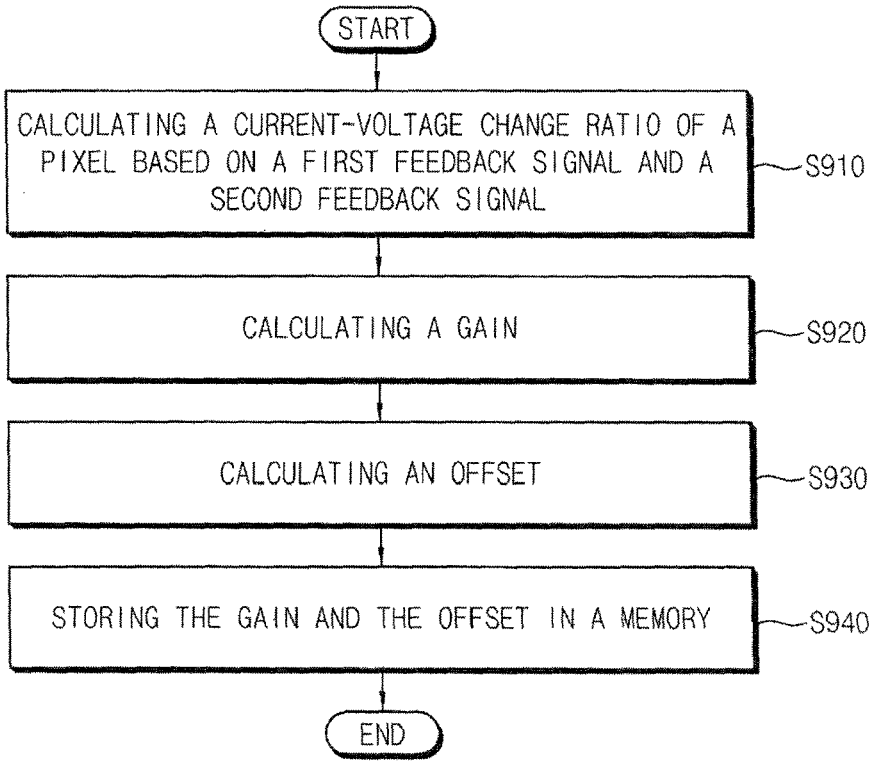
FIG. 9 is a flowchart illustrating an example embodiment in which a current-voltage characteristic is modeled by the method of FIG. 8.

FIG. 9 is a flowchart illustrating an example embodiment in which a current-voltage characteristic is modeled by the method of FIG. 8 (see S830).

Referring to FIGS. 1 and 9, modeling the current-voltage characteristic of the pixel 111 (i.e., the method of FIG. 9) may calculate a current-voltage change-ratio of the pixel based on the first feedback signal sensed at the feedback line based on the first reference signal and the second feedback signal sensed at the feedback line based on the second reference signal (S910). For example, the current-voltage change-ratio may be calculated based on a difference (e.g., $\Delta V$) between the first reference signal and the second reference signal, and based on a difference (e.g., $\Delta I$) between the first feedback signal and the second feedback signal.

The method of FIG. 9 may calculate a gain of the pixel 111 (S920), and may calculate an offset value of the pixel (S930). Here, the gain may represent a ratio of the current-voltage change-ratio, that is calculated, to a reference current-voltage change-ratio of a reference current-voltage characteristic, which may be predetermined. A configuration of calculating the gain and the offset value may be substantially the same as or similar to a configuration of calculating a gain and an offset value described with reference to FIG. 5.

The method of FIG. 9 may store the gain and the offset value of the pixel 111 (S940).

In an example embodiment, the method of FIG. 9 may be performed in a manufacturing process of the organic light emitting display device 100.

Figure 10:
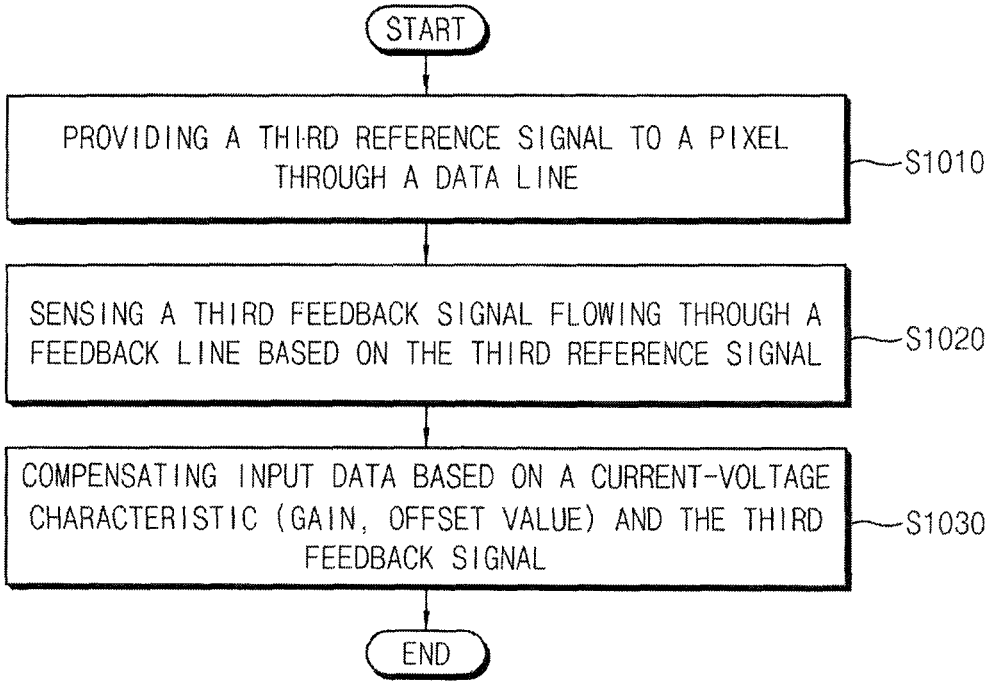
FIG. 10 is a flowchart illustrating a method of driving an organic light emitting display device according to example embodiments.

FIG. 10 is a flowchart illustrating a method of driving an organic light emitting display device according to example embodiments.

Referring to FIG. 10, the method of FIG. 10 may be performed in a driving period (or a sensing period that is allocated independently).

The method of FIG. 10 may provide a third reference signal to the pixel through the data line (S1010). Here, the third reference signal may be voltages provided to the pixel for calculating a degradation current.

The method of FIG. 10 may sense a third feedback signal that is feedbacked (or that flows) through the feedback line (S1020). Here, the third feedback signal may be a feedback current that flows through an organic light emitting diode of the pixel and the feedback line based on the third reference signal.

The method of FIG. 10 may compensate input data based on the gain and the offset value (e.g., the current-voltage characteristic) of the pixel, and based on the third feedback signal, where the gain and the offset may be pre-stored (S1030).

The method of FIG. 10 may compensate the third feedback signal based on the gain and the offset value of the pixel, may calculate a degradation current of the pixel based on a the third feedback signal that is compensated, and may compensate the input data based on the degradation current. A configuration of compensating the input data may be substantially the same as or similar to a function of the compensation block 320 described with reference to FIG. 3.

As described above, the method of driving an organic light emitting display device may provide reference signals to the pixel, may sense the feedback signals that are feedbacked based on the reference signals, and may calculate and store the gain and the offset value of the pixel based on the feedback signals. In addition, the method may compensate a sensing signal (or a feedback sensing signal), sensed for degradation compensation, based on the gain and the offset value that are pre-stored. Therefore, the method may improve accuracy of degradation compensation by performing degradation compensation based on a compensated feedback signal (or a compensated sensing signal).

The present inventive concept may be applied to any suitable display device (e.g., an organic light emitting display device, a liquid crystal display device, etc.). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A method of driving an organic light emitting display device comprising a pixel coupled to a data line and a feedback line, the method comprising:

providing reference signals to the pixel through the data line;

sensing feedback signals through the feedback line in response to the reference signals; and modeling a current-voltage characteristic of the pixel based on the feedback signals, wherein the modeling the current-voltage characteristic of the pixel comprises:

calculating a current-voltage change-ratio of the pixel representing a ratio of a change of the feedback signals to a change of the reference signals, based on a first feedback signal of the feedback signals in response to a first reference signal of the reference signals, and based on a second feedback signal of the feedback signals in response to a second reference signal of the reference signals;

calculating a gain representing a ratio of the current-voltage change-ratio of the pixel to a reference current-voltage change-ratio of a reference pixel; and calculating an offset value representing a difference between the current-voltage characteristic of the pixel and a reference current-voltage characteristic of the reference pixel.

2. The method of claim 1, wherein the modeling the current-voltage characteristic of the pixel further comprises storing the gain and the offset value in a memory device.

3. The method of claim 2, further comprising:

sensing a third feedback signal through the feedback line in response to a third reference signal of the reference signals; and generating compensation data by compensating input data based on the gain, the offset value, and the third feedback signal.

4. The method of claim 3, wherein the generating the compensation data comprises:

compensating the third feedback signal based on the gain and the offset value;

calculating a degradation current of the pixel based on a compensated third feedback signal; and compensating the input data based on the degradation current.

5. An organic light emitting display device comprising:

a display panel comprising a pixel coupled to a data line and a feedback line;

a data driver configured to provide a first reference signal and a second reference signal to the pixel through the data line;

a sensing driver configured to sense a first feedback signal and a second feedback signal through the feedback line in response to the first reference signal and the second reference signal, respectively; and a timing controller configured to:

model a current-voltage characteristic of the pixel based on the first and second feedback signals;

calculate a current-voltage change-ratio of the pixel that is equal to a ratio of a difference between the first feedback signal and the second feedback signal to a difference between the first reference signal and the second reference signal;

calculate a gain that is equal to a ratio of the current-voltage change-ratio of the pixel to a reference current-voltage change-ratio of a reference pixel; and calculate an offset value representing a difference between the current-voltage characteristic of the pixel and a reference current-voltage characteristic of the reference pixel.

6. The organic light emitting display device of claim 5, wherein the timing controller comprises a memory device configured to store the gain and the offset value.

7. The organic light emitting display device of claim 5, wherein each of the feedback signals comprises a current value of a current that flows through the feedback line in response to each of the reference signals.

8. The organic light emitting display device of claim 5, wherein the timing controller is further configured to model the current-voltage characteristic during an initial driving phase of the organic light emitting display device.

9. The organic light emitting display device of claim 5, wherein the timing controller is further configured to accumulate input data, and to model the current-voltage characteristic when accumulated input data exceeds a reference value.

10. The organic light emitting display device of claim 5, wherein the display panel further comprises a first pixel, a second pixel, and a third pixel, and wherein the timing controller is further configured to model a first current-voltage characteristic of the first pixel and a second current-voltage characteristic of the second pixel, and to store the first current-voltage characteristic and the second current-voltage characteristic.

11. The organic light emitting display device of claim 10, wherein the timing controller is configured to calculate a third current-voltage characteristic of the third pixel based on the first current-voltage characteristic and the second current-voltage characteristic.

12. The organic light emitting display device of claim 10, wherein the timing controller is further configured to determine the first pixel and the second pixel based on a characteristic dispersion of the display panel.

13. An organic light emitting display device comprising:

a display panel comprising a pixel coupled to a data line and a feedback line;

a data driver configured to provide a reference signal to the pixel through the data line;

a sensing driver configured to sense a feedback signal through the feedback line in response to the reference signal; and a timing controller configured to compensate input data based on the feedback signal and based on a current-voltage characteristic of the pixel, the current-voltage characteristic comprising a gain and an offset value, wherein the gain represents a ratio of a current-voltage change-ratio of the pixel to a reference current-voltage change-ratio of a reference pixel, and wherein the offset value represents a difference between the current-voltage characteristic of the pixel and a reference current-voltage characteristic of the reference pixel.

14. The organic light emitting display device of claim 13, wherein the timing controller is further configured to compensate the feedback signal based on the gain and based on the offset value of the pixel.

15. The organic light emitting display device of claim 13, wherein the timing controller is further configured to calculate a degradation current of the pixel based on a compensated feedback signal, and is further configured to compensate the input data based on the degradation current.

16. The organic light emitting display device of claim 13, wherein the display panel further comprises a first pixel, a second pixel, and a third pixel, and wherein the timing controller is further configured to calculate a third current-voltage characteristic of the third pixel based on a first current-voltage characteristic of the first pixel, and a second current-voltage characteristic of the second pixel.

* * * * *